US011551860B2

(12) United States Patent
Adachi et al.

(10) Patent No.: US 11,551,860 B2
(45) Date of Patent: Jan. 10, 2023

(54) IGNITION COIL

(71) Applicant: DENSO CORPORATION, Kariya (JP)

(72) Inventors: Norihiro Adachi, Kariya (JP); Junichi Wada, Kariya (JP)

(73) Assignee: DENSO CORPORATION, Kariya (JP)

( * ) Notice: Subject to any disclaimer, the term of this patent is extended or adjusted under 35 U.S.C. 154(b) by 165 days.

(21) Appl. No.: 17/171,345

(22) Filed: Feb. 9, 2021

(65) Prior Publication Data

US 2021/0249187 A1 Aug. 12, 2021

(30) Foreign Application Priority Data

Feb. 10, 2020 (JP) ..... JP2020-020340

(51) Int. Cl.
*H01F 27/26* (2006.01)
*H01F 38/12* (2006.01)

(52) U.S. Cl.
CPC ..... *H01F 38/12* (2013.01); *H01F 27/263* (2013.01); *H01F 2038/122* (2013.01); *H01F 2038/127* (2013.01)

(58) Field of Classification Search
CPC .. H01F 38/12; H01F 27/263; H01F 2038/122; H01F 2038/127; H01F 27/245
See application file for complete search history.

(56) References Cited

U.S. PATENT DOCUMENTS 8,289,117 B2 * 10/2012 Dal Re ..... H01F 3/14 335/229
10,236,117 B2 * 3/2019 Hori ..... F02P 3/02
2004/0217841 A1 11/2004 Nuebel et al.
2005/0134417 A1 6/2005 Maekawa et al.
2012/0299679 A1 11/2012 Kobayashi et al.
2018/0366269 A1 12/2018 Hori
2021/0233704 A1 * 7/2021 Torii ..... H01F 27/26

FOREIGN PATENT DOCUMENTS

| | | | |
|---|---|---|---|
| DE | 102006044436 | | 3/2008 |
| JP | H03-116704 | | 5/1991 |
| JP | H06-244035 | | 9/1994 |
| JP | 2006287089 | A * | 10/2006 |
| JP | 2007-194364 | | 8/2007 |
| JP | 2008-171964 | | 7/2008 |
| JP | 2009-290147 | | 12/2009 |
| JP | 2012-064610 | | 3/2012 |

* cited by examiner

*Primary Examiner* — Tuyen T Nguyen
(74) *Attorney, Agent, or Firm* — Nixon & Vanderhye P.C.

(57) ABSTRACT

An ignition coil includes a center core, a first core member, and a second core member. The first core member includes a first core-facing portion facing a front core surface of the center core and a first core side portion extending rearward from the first core-facing portion. The second core member includes a second core-facing portion facing a rear core surface of the center core and a second core side portion extending frontward from the second core-facing portion. The first core-facing portion has an end surface contacting a portion of the second core side portion to create a first contact region. Similarly, the second core-facing portion has an end surface contacting a portion of the first core side portion to create a second contact region. The first and second contact regions are shaped to approach frontward close to the first core side portion. This structure enhances productivity of the ignition coil.

6 Claims, 9 Drawing Sheets

IGNITION COIL

CROSS REFERENCE TO RELATED DOCUMENT

The present application claims the benefit of priority of Japanese Patent Application No. 2020-020340 filed on Feb. 10, 2020, the disclosure of which is incorporated herein by reference.

BACKGROUND

1 Technical Field

This disclosure relates generally to an ignition coil.

2 Background Art

Japanese patent first publication No. 2009-290147 teaches an ignition coil equipped with a center core disposed inside a primary coil and a secondary coil, a permanent magnet arranged on an end of the center core, and first and second side cores. The first and second side cores partly face respective ends of length or axis of the center core. The first and second side cores surround the center core in an annular shape.

The first and second side cores are each of a substantially L-shape and joined together in a circular shape. The first side core is in contact with a first end of the center core on which the permanent magnet is disposed. The second side core is in contact with a second end of the center core opposite the first end. The first and second side cores have ends which face in a direction perpendicular to the axial direction of windings of the primary and secondary coils (which will also be referred to as a perpendicular direction) and are joined together.

When an air gap exists between the first side core and the permanent magnet or between the second side core and the second end of the center core, it will result in a decrease in performance of the ignition coil.

In order to alleviate the above drawback, the ignition coil of the above publication is designed to have the joined ends of the first and second side cores which are shaped to have surfaces extending parallel to the axial direction of the center core. The assembly of the first and second side cores with the center core and the permanent magnet in an assembling process of the ignition coil is achieved by facing the ends of the first and second side cores each other in the perpendicular direction, placing the ends of the first side core in contact with the ends of the second side core, and sliding the first and second side cores in the perpendicular direction to move the ends of the first and second side cores close to each other, thereby aligning the ends of the first side core with the ends of the second side core in the perpendicular direction.

The ignition coil of the above publication is, however, needed to press the first and second side cores close to each other both in the perpendicular direction and in the axial direction of the center core in the assembling process, thereby resulting in a complicated assembly process of the ignition coil. There is, therefore, still room for technical improvement of productivity of the ignition coil.

SUMMARY

It is, thus, an object of this disclosure to provide an ignition coil which is capable of enhancing productivity thereof.

According to one aspect of this disclosure, there is provided an ignition coil which comprises: (a) a primary coil and a secondary coil which are magnetically coupled with each other; (b) a center core which is disposed inside inner peripheries of the primary coil and the secondary coil, the center core having a first surface and a second surface aligned with the first surface in an axial direction of the primary and the secondary coils; (c) a first core member which includes a first core-facing portion and a first core side portion, the first core-facing portion faces the first surface of the center core, the first core side portion extending from the first core-facing portion in a first axial direction defined to be opposite a second axial direction along the axial direction of the primary and secondary coils, the first core member being arranged outside outer peripheries of the primary coil and the secondary coil; and (d) a second core member which includes a second core-facing portion and a second core side portion, the second core-facing portion facing the second surface of the center core, the second core side portion extending from the second core-facing portion in the second axial direction and being located on an opposite side of the center core to the first core side portion in an orthogonal direction perpendicular to the axial direction of the primary and secondary coils, the second core member being arranged outside the outer peripheries of the primary coil and the secondary coil. The first core-facing portion has an end surface which faces away from the first core side portion in the orthogonal direction. The end surface of the first core-facing portion faces in contact with a portion of the second core side portion to create a first contact region. The second core-facing portion has an end surface which faces away from the second core side portion in the orthogonal direction. The end surface of the second core-facing portion faces in contact with a portion of the first core side portion to create the second contact region. Each of the first contact region and the second contact region is geometrically oriented to approach in the second axial direction close to the first core side portion facing the second core side portion in the orthogonal direction.

The ignition coil is, as described above, equipped with the first contact region and the second contact region each of which is shaped to approach in the second axial direction close to the first core side portion, in other words, extend at a given angle to a center line of an outer core made up of the first core member and the second core member. This facilitates assembly of the first core member and the second core member, thereby enhancing the productivity of the ignition coil.

Symbols in brackets in the claims are used only to indicate correspondences to parts discussed in the following embodiments and do not limit the technical scope of the disclosure.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

First Embodiment

The structure of the ignition coil 1 will be described below with reference to FIGS. 1 to 7.

Figure 1:
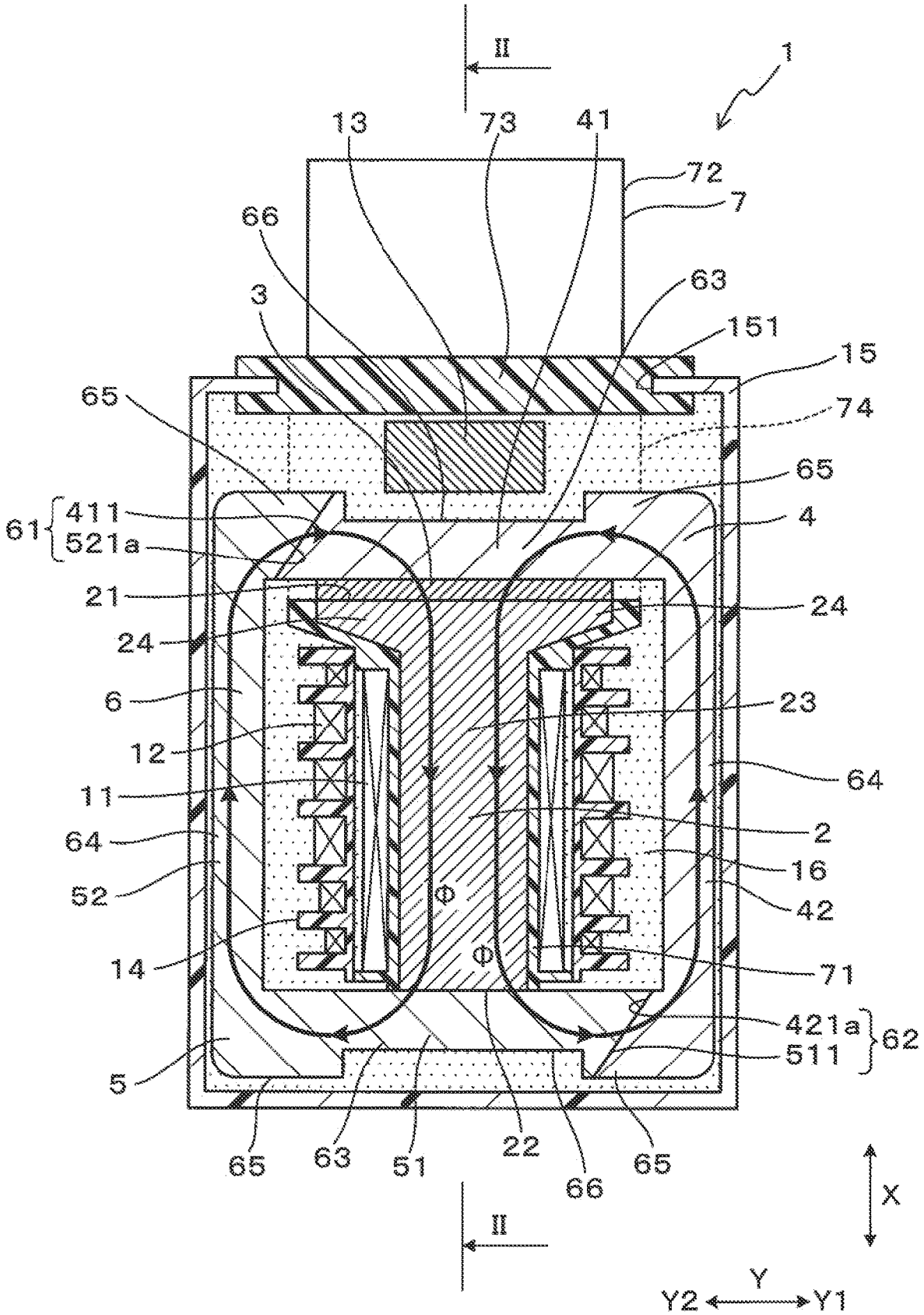
FIG. 1 is a sectional view which illustrates an ignition coil according to the first embodiment.

The ignition coil 1, as illustrated in FIG. 1, includes the primary coil 11, the secondary coil 12, the center core 2, the first core member 4, and the second core member 5.

The primary coil 11 and the secondary coil 12 are magnetically coupled with each other. The center core 2 is disposed inside inner peripheries of the primary coil 11 and the secondary coil 12.

Figure 3:
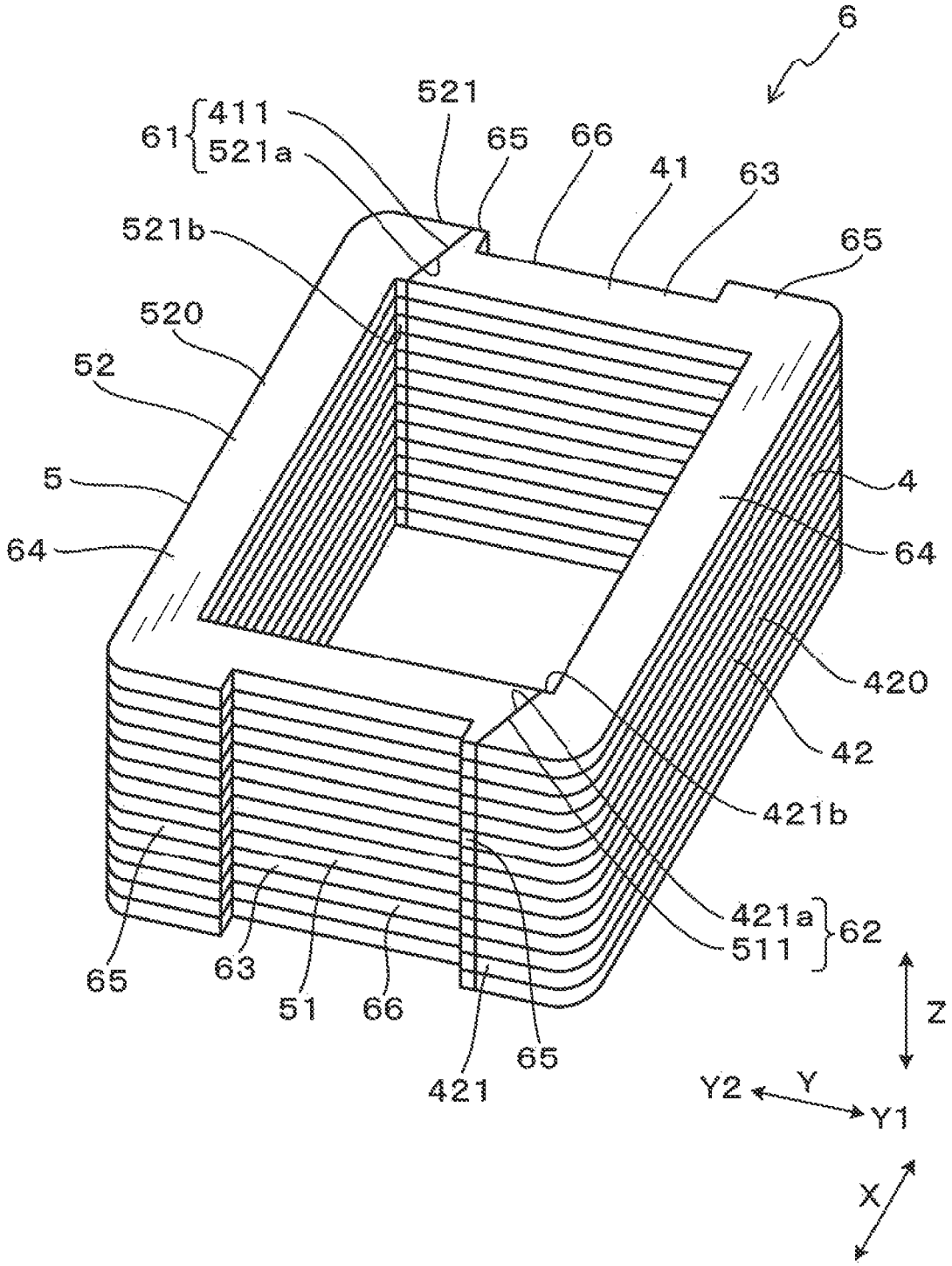
FIG. 3 is a perspective view which shows an outer core in the first embodiment.
Figure 4:
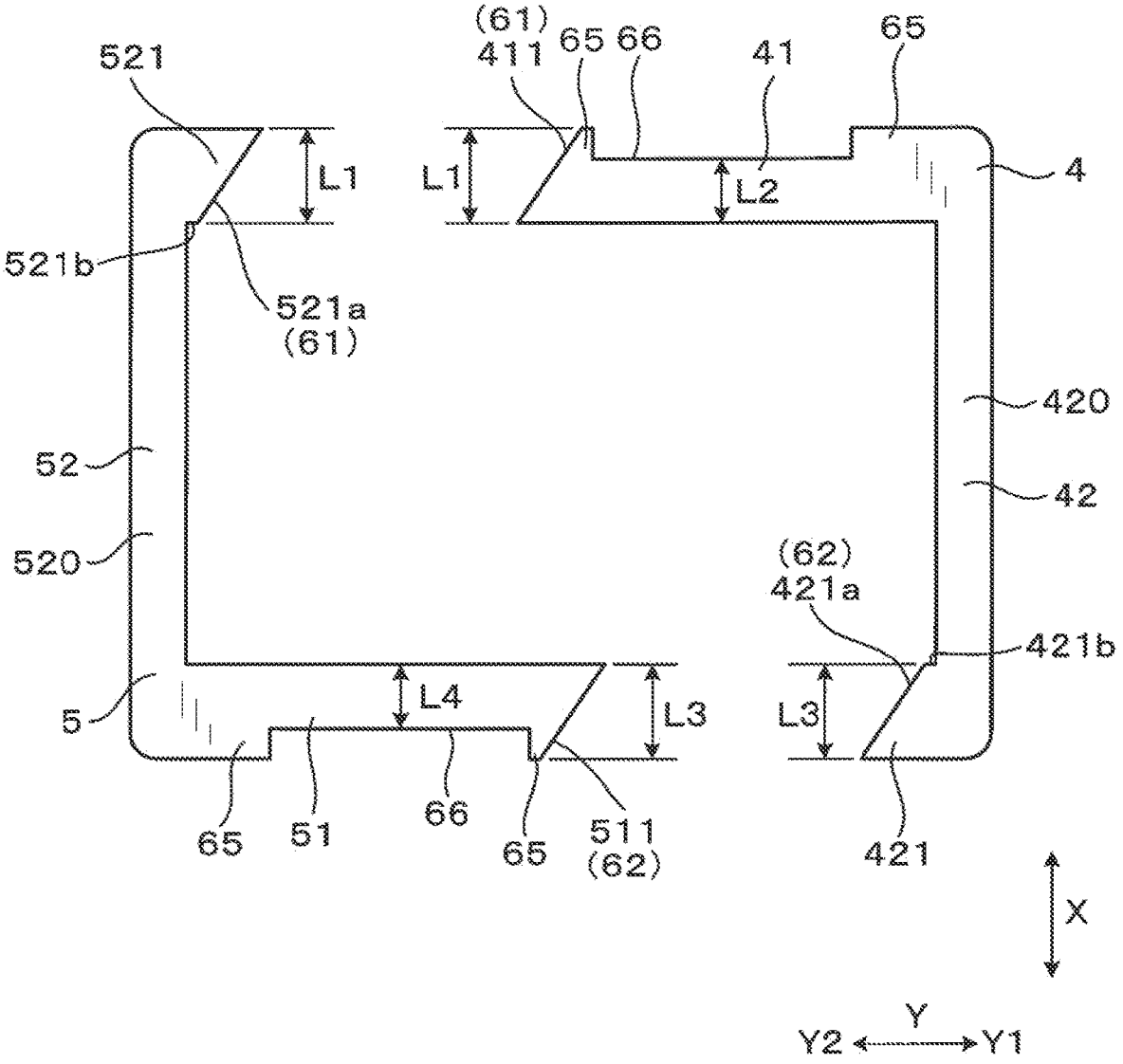
FIG. 4 is an exploded view which illustrates an outer core of the ignition coil shown in FIG. 1.

The first core member 4, as clearly illustrated in FIGS. 1, 3, and 4, includes the first core-facing portion 41 and the first core side portion 42. The first core-facing portion 41, as clearly illustrated in FIG. 1, faces the front core surface 21 (which will also be referred to as a first surface) of the center core 2 in a lengthwise direction of the center core 2 (i.e., an axial direction of the primary and secondary coils 11 and 12). The first core side portion 42 faces the periphery of the center core 2 and extends from the first core-facing portion 41 backward (which will also be referred to as a first axial direction) in the axial direction X of the ignition coil 1 (which will also be referred to as a coil axial direction). The first core member 4 is disposed outside outer peripheries of the primary coil 11 and the secondary coil 12.

Figure 2:
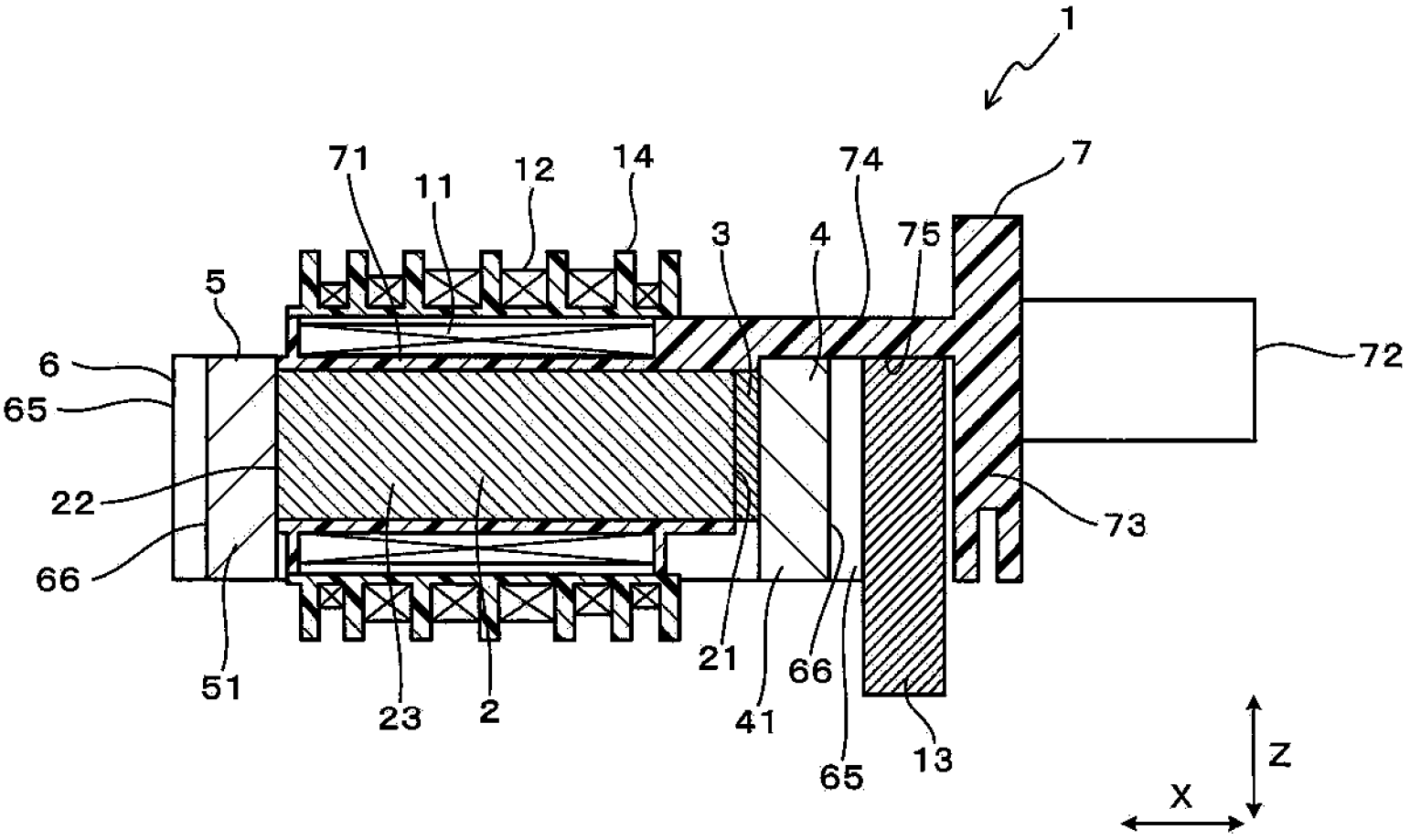
FIG. 2 is a sectional view taken along the line 11-11 in FIG. 1.

Similarly, the second core member 5, as illustrated in FIGS. 1, 3, and 4, includes the second core-facing portion 51 and the second core side portion 52. The second core-facing portion 51, as can be seen in FIG. 2, faces the rear core surface 22 (which will also be referred to as a second surface) of the center core 2 in the lengthwise direction of the center core 2. The second core side portion 52 extends frontward (which will also be referred to as a second axial direction) from the second core-facing portion 51 in the axial direction X of the ignition coil 1. The second core side portion 52 is arranged on an opposite side of the center core 2 to the first core side portion 42 in a direction Y perpendicular to the coil axial direction X (which will also be referred to as an orthogonal direction). The second core member 5 is disposed outside the outer peripheries of the primary coil 11 and the secondary coil 12.

The first core-facing portion 41, as clearly illustrated in FIGS. 1 and 3, has the end surface 411 which faces away from the first core side portion 41 in the orthogonal direction Y. The end surface 411 is in direct contact with a portion (i.e., an end surface) of the second core side portion 52 to create the first contact region 61. Similarly, the second core-facing portion 51 has the end surface 511 which faces away from the second core side portion 52 in the orthogonal direction Y. The end surface 511 is in direct contact with a portion (i.e., an end surface) of the first core side portion 42 to create the second contact region 62. Each of the first contact region 61 and the second contact region 62 slant at a given angle to the coil axial direction X. In other words, each of the first contact region 61 and the second contact region 62 is shaped or oriented to approach frontward close to the first core side portion 42 facing the second core side portion 51 in the orthogonal direction Y. In other words, each of the first contact region 61 and the second contact region 62 has a first edge and a second edge which are aligned with each other in the X-direction. The first contact region 61 and the second contact region 62 are shaped or oriented to have the first edges located closer to the first core side portion 42 than the second edges are in the X-direction.

The structure of the ignition coil 1 will also be described below in detail.

The coil axial direction X, as referred to therein, is a direction in which an axis of a winding of each of the primary coil 11 and the secondary coil 12 extends. In the following discussion the coil axial direction X will also be merely referred to as X-direction. The frontward direction of the ignition coil 1 will also be referred to as a first X-direction (i.e., the second axial direction described above). The front side, as referred to herein, is a region where the magnet 3, which will be described later in detail, is arranged on the center core 2. The rearward direction of the ignition coil 1 will also be referred to as a second X-direction (i.e., the first axial direction described above). The rear side, as referred to herein, is a region located away from the front side in the second X-direction. "front" or "rear" used in this discussion are only for convenience sake and does not specify orientation of the ignition coil 1 mounted in the vehicle. The orthogonal direction Y will also be merely referred to as Y-direction. A direction perpendicular to the X-direction and the Y-direction will also be referred to as Z-direction.

The ignition coil 1 in this embodiment is used with, for example, internal combustion engines for automobiles or cogeneration systems. The ignition coil 1 is connected to a spark plug (not shown) mounted in the internal combustion engine and works to apply a high voltage to the spark plug to produce electrical sparks.

The center core 2, as clearly illustrated in FIGS. 1 and 2, has a length extending in the X-direction. For instance, the center core 2 is made of a plurality of magnetic steel plates which are each made from soft-magnetic material and stacked to overlap each other in the Z-direction. The center core 2, as can be seen in FIG. 1, has a substantially T-shaped cross section extending perpendicular to the Z-direction. Specifically, the center core 2 includes the rectangular columnar body 23 and the flange 24. The columnar body 23 has a length extending in the X-direction. The flange 24 projects outward from the front end of the columnar body 23 in opposite directions parallel to the Y-direction. The flange 24 provides an increased area of the front core surface 21 of the center core 2 to achieve installation of the magnet 3 having a large sectional area extending perpendicular to the X-direction on the front core surface 21. The ignition coil 1 has the magnet 3 which faces the front core surface 21 and is disposed in contact with the front core surface 21.

The magnet 3 is of a rectangular plate shape having a given thickness in the X-direction. The magnet 3 has the same size as that of the front core surface 21, as viewed in the X-direction and occupies substantially an overall area of the front core surface 21. The magnet 3 works to magnetically bias the center core 2 to increase a change in magnetic flux Φ upon deenergization of the primary coil 11, thereby raising voltage induced in the secondary coil 12 in order increase output voltage from the ignition coil 1. The larger a sectional area of the magnet 3, the higher a magnetic bias applied to the center core 2 unless the material of the magnet 3 is changed. The first core member 4 and the second core member 5 are arranged to surround the center core 2 and the magnet 3 in the X-direction and the Y-direction.

Each of the first core member 4 and the second core member 5 is, as can be seen in FIG. 3, made of a plurality of magnetic steel plates which are each made from soft-magnetic material and stacked to overlap each other to have a thickness in the Z-direction. The first core member 4 and the second core member 5 are assembled together to complete the annular outer core 6. The outer core 6 forms a magnetic path along with the center core 2 through which the magnetic flux Φ, as produced around the primary coil 11 and the secondary coil 12 upon deenergization of the primary coil 11, passes. The outer core 6 is of a rectangular frame shape which has two lateral sides 63 extending in the Y-direction and two longitudinal sides 64 extending in the X-direction.

Each of the lateral sides 63 of the outer core 6, as illustrated in FIGS. 1 and 3, has two convex core protrusions 65 formed on ends thereof aligned with each other in the Y-direction. The core protrusions 65 project from the ends of each of the lateral sides 63 outside the outer core 6 in the X-direction. In other words, the core protrusions 65 of each of the lateral sides 63 define the concave core recess 66 which is located at a middle of a length of the lateral side 63 in the Y-direction and hollowed in the X-direction. Each of the core recess 66 occupies a whole of a thickness of each of the first core-facing portion 41 and the second core-facing portion 51 in the Z-direction, thereby having open ends opposed to each other in the Z-direction.

The outer core 6, as illustrated in FIG. 2, has a dimension larger than those of the center core 2 and the magnet 3 in the Z-direction. In other words, the outer core 6 has ends which are aligned with each other in the Z-direction and protrude outside the center core 2 and the magnet 3 in the Z-direction.

Each of the first core member 4 and the second core member 5 is, as clearly illustrated in FIGS. 1, 3, and 4, of a substantially L-shape in cross section extending perpendicular to the Z-direction. In this embodiment, the first core member 4 and the second core member 5 are identical in configuration and shape with each other. Specifically, the first core member 4 and the second core member 5 are a mirror image of each other when one of them is turned 180° around a center line extending in the Y-direction.

The first core-facing portion 41 of the first core member 4 is of a plate-like shape and has a thickness in the X-direction. The first core-facing portion 41, as can be seen in FIG. 1, extend in the Y-direction and faces the core front surface 2 of the center core 2 through the magnet 3. The first core-facing portion 41 has a rear surface placed in direct contact with a front surface of the magnet 3.

The end surface 411 of the first core-facing portion 41 which, as illustrated in FIGS. 1, 3, and 4, faces in the Y2-direction (i.e., the leftward direction in FIGS. 1, 3, and 4) is shaped to be flat or even and tapers to the longitudinal center line of the ignition coil 1. As viewed on a cross section of the first core-facing portion 41, the end surface 411 is inclined straight at a given angle (excluding zero) both to the X-direction and to the Y-direction. The end surface 411 of the first core-facing portion 41 lies in a region where the left core protrusion 65 of the first core-facing portion 41 exists. In other words, a portion of the end surface 411 defines a portion of a surface of the core protrusion 65. The core recess 66 lies at a given interval away from the end surface 411 of the first core-facing portion 41 in the Y1-direction (i.e., the rightward direction in FIGS. 1, 3, and 4). The first core side portion 42 extends rearward from the end of the first core-facing portion 41 which faces in the Y1-direction.

The first core side portion 42 includes the first straight portion 420 and the first protrusion 421. The first straight portion 420 extends straight rearward from the first core-facing portion 41 in the X-direction. The first straight portion 420 has a first end and a second end aligned with the first end in the X-direction. The first end faces in the frontward direction. The second end faces in the rearward direction. The first protrusion 421 projects from a rear end (i.e., the second end) of the first straight portion 420 in the Y2-direction. The first protrusion 421 has the first protrusion end surface 421*a* which faces away from the first straight portion 420 in the Y2-direction. In other words, the first protrusion end surface 421*a* is, as can be seen in FIGS. 3 and 4, arranged away from the first straight portion 420 and has a front edge which continues to an inner surface of the first straight portion 420 through the inner side surface 421*b* of the first protrusion 421 which faces inwardly, that is, frontward. The first protrusion end surface 421*a* is shaped to be flat or even and extends parallel to the end surface 511 of the second core-facing portion 51. The first core member 4 is, as illustrated in FIGS. 1 and 3, arranged to have the first protrusion end surface 421*a* which faces and in direct contact with the end surface 511 of the second core-facing portion 51.

The second core-facing portion 51 of the second core member 5 is, as illustrated in FIGS. 1, 3, and 4, of a plate-like shape and has a thickness in the X-direction. The second core-facing portion 51, as clearly illustrated in FIG. 1, extends in the Y-direction and has a front surface (i.e., an inner surface) which faces and is placed in direct contact with the rear core surface 22.

The end surface 511 of the second core-facing portion 51 which, as illustrated in FIGS. 1, 3, and 4, faces in the Y1-direction (i.e., the rightward direction in FIGS. 1, 3, and 4) is shaped to be flat or even and tapers to the longitudinal center line of the ignition coil 1. As viewed on a cross section of the second core-facing portion 51, the end surface 511 is inclined straight at a given angle (excluding zero) both to the X-direction and to the Y-direction. In other words, the end surface 511 extends parallel to the first protrusion end surface 421*a* of the first protrusion 421 of the first core member 4. The end surface 511 of the second core-facing portion 51 lies in a region where the right core protrusion 65 exists. The core recess 66 of the second core-facing portion 51 lies at a given interval away from the end surface 511 of the second core-facing portion 51 in the Y2-direction (i.e., the rightward direction in FIGS. 1, 3, and 4). The end surface 511 of the second core-facing portion 51 is substantially identical in size or area with the first protrusion end surface 421*a* of the first protrusion 421. The whole of the end surface 511 of the second core-facing portion 51 coincides with, in other words, directly contacts the whole of the first protrusion end surface 421*a* of the first protrusion 421. The end surface 511 of the second core-facing portion 51 and the first protrusion end surface 421*a* of the first protrusion 421 face each other in direct contact with each other to create the second contact region 62. The second core side portion 52 extends frontward from an end of the second core-facing portion 51 which faces in the Y2-direction.

The second core side portion 52 includes the second straight portion 520 and the second protrusion 521. The second straight portion 520 extends straight frontward from the second core-facing portion 51 in the X-direction. The second straight portion 520 has a first end and a second end aligned with the first end in the X-direction. The first end faces in the frontward direction. The second end faces in the rearward direction. The second protrusion 521 projects from a front end (i.e., the first end) of the second straight portion 520 in the Y1-direction. The second protrusion 521 has the second protrusion end surface 521*a* which faces away from the second straight portion 520 in the Y1-direction. In other words, the second protrusion end surface 521*a* is, as can be seen in FIGS. 3 and 4, arranged away from the second straight portion 520 and has a rear edge which continues to an inner surface of the second straight portion 520 through the inner side surface 521*b* of the second protrusion 521 which faces inwardly, that is, rearward. The second protrusion end surface 521*a* is shaped to be flat or even and extends parallel to the end surface 411 of the first core-facing portion 41. In this embodiment, the end surface 411 of the first core-facing portion 41, the first protrusion end surface 421*a* of the first protrusion 421, the end surface 511 of the second core-facing portion 51, and the second protrusion end surface 521*a* of the second protrusion 521 extend substantially parallel to each other. The second core member 5 is, as illustrated in FIGS. 1 and 3, arranged to have the second protrusion end surface 521*a* which faces and in direct contact with the end surface 411 of the first core-facing portion 41.

The second protrusion end surface 521*a* of the second protrusion 521 is identical in size or area with the end surface 411 of the first core-facing portion 41. The whole of the second protrusion end surface 521*a* of the second protrusion 521 coincides with, in other words, directly contacts the whole of the end surface 411 of the first core-facing portion 41. The second protrusion end surface 521*a* of the second protrusion 521 and the end surface 411 of the first core-facing portion 41 face each other in direct contact with each other to create the first contact region 61. The first contact region 61 and the second contact region 62 are each shaped to have a flat or even surface and extend parallel to each other.

At least one of the end surface 411 of the first core-facing portion 41 and the second protrusion end surface 521*a* of the second protrusion 521 which define the first contact region 61, as illustrated in FIG. 4, has a dimension (i.e., width) which is larger in the X-direction than that of a given portion of the first core-facing portion 41 which is located away from the first contact region 61 in the Y1-direction. Specifically, in this embodiment, the end surface 411 of the first core-facing portion 41 and the second protrusion end surface 521*a* of the second protrusion 521 each have a dimension L1 which is larger in the X-direction than a dimension L2 of a portion of the first core-facing portion 41 in which the core recess 66 is formed. Similarly, at least one of the end surface 511 of the second core-facing portion 51 and the first protrusion end surface 421*a* of the first protrusion 421 which define the second contact region 62 has a dimension (i.e., width) which is larger in the X-direction than that of a given portion of the second core-facing portion 51 which is located away from the second contact region 62 in the Y2-direction. Specifically, in this embodiment, the end surface 511 of the second core-facing portion 51 and the first protrusion end surface 421*a* of the first protrusion 421 each have a dimension L3 which is larger in the X-direction than a dimension L4 of a portion of the second core-facing portion 51 in which the core recess 66 is formed. In this embodiment, the dimension L1 is equal to the dimension L3. The dimension L2 is equal to the dimension L4.

The ignition coil 1 is, as clearly illustrated in FIGS. 1 and 2, equipped with the primary spool (i.e., bobbin) 71 in which the center core 2 is embedded. The primary spool 71 has the primary coil 11 wound around an outer periphery thereof. The center core 2 has the front core surface 21 and the rear core surface 22 which are exposed outside the primary spool 71. The primary spool 71 constitutes the connector module 7 along with the connector 72.

The connector module 7 has the connector 72 which forms a front end portion thereof. The connector 72 is a connector for electrically connecting the ignition coil 1 with an external device. The connector module 7, as illustrated in FIG. 1, has the joint wall 73 which achieves engagement or joint of the connector module 7 with the case 15 of the ignition coil 1. The connector 72 protrudes frontward from the joint wall 73 of the connector module 7. The joint wall 73 and the primary spool 71 are, as can be seen in FIG. 2, connected together through the connecting wall 74. The connecting wall 74 is offset from center axes of the first core-facing portion 41 and the magnet 3 in the Z-direction.

The connector 72, the joint wall 73, the connecting wall 74, and the primary spool 71 constitute the connector module 7. Specifically, the formation of the connector module 7 is achieved using insert-moulding techniques by placing metal joining terminals of the connector 72 and the center core 2 in a forming mould and then injecting electrically insulated resin into the forming mould to complete the connector module 7.

The connector module 7, as illustrated in FIG. 2, has the installation chamber 75 which is surrounded by the joint wall 73, the connecting wall 74, and the primary spool 71 and shaped in the form of a concave recess. The installation chamber 75 has an opening oriented in the Z-direction and also has openings oriented both in the Y1- and in the Y2-directions. The first core-facing portion 41 of the outer core 6 and the igniter 13, which will be described later in detail, are inserted into the installation chamber 75.

The igniter 13 is arranged in front of the outer core 6 within the installation chamber 75. The igniter 13 works to control energization or deenergization of the primary coil 11. The igniter 13 is, as can be seen in FIG. 1, disposed in front of the outer core 6 between the core protrusions 65 of the lateral side 63 which are opposed to each other in the Y-direction. The igniter 13 faces the front core recess 66 of the outer core 6 in the X-direction. The igniter 13 has a dimension (i.e., length) in the Y-direction which is smaller than that of the core recess 66 of the first core-facing portion 41 in the Y-direction. The igniter 13 is located inside the core recess 66 of the first core-facing portion 41, as viewed in the Y-direction. Although not illustrated, the igniter 13 is equipped with terminals which extend away from the opening of the installation chamber 75 which faces in the Z-direction and pass through holes formed in the connecting wall 74.

The secondary spool 14 is, as illustrated in FIGS. 1 and 2, disposed outside the outer periphery of the primary spool 71. The secondary spool 14 is of a hollow cylindrical shape and made of electrically insulating resin. The primary spool 71 is disposed inside the secondary spool 14. The secondary coil 12 is wound around an outer periphery of the secondary spool 14. The secondary coil 12 is located coaxially with the primary coil 11.

The ignition coil 1, as can be seen in FIG. 1, has component parts thereof disposed inside the case 15 and the joint wall 73 secured to the case 15. The case 15 is made from electrically insulating resin. The case 15 has an opening which faces away from the opening of the installation chamber 75 which faces in the Z-direction. The case 15 has formed in the front wall thereof the concave joint recess 151 in which the joint wall 73 is fit. The joint recess 151 is formed by cutting a portion of the front wall of the case 15 to have an opening facing in the Z-direction. The installation of the joint wall 73 of the connector module 7 in the case 15 is achieved by engaging the joint wall 73 with the joint recess 151 and inserting the connector module 7 into the opening of the case 15.

The resinous seal 16 is disposed in an inner chamber surrounded by the case 15 and the joint wall 73. The resinous seal 16 is made from, for example, electrically insulating thermoset resin. The resinous seal 16 hermetically seal the component parts of the ignition coil 1 disposed inside the case 15 and the joint wall 73.

An example of how to install the component parts of the ignition coil 1 in the case 15 will be described below with reference to FIGS. 5 to 7.

Figure 5:
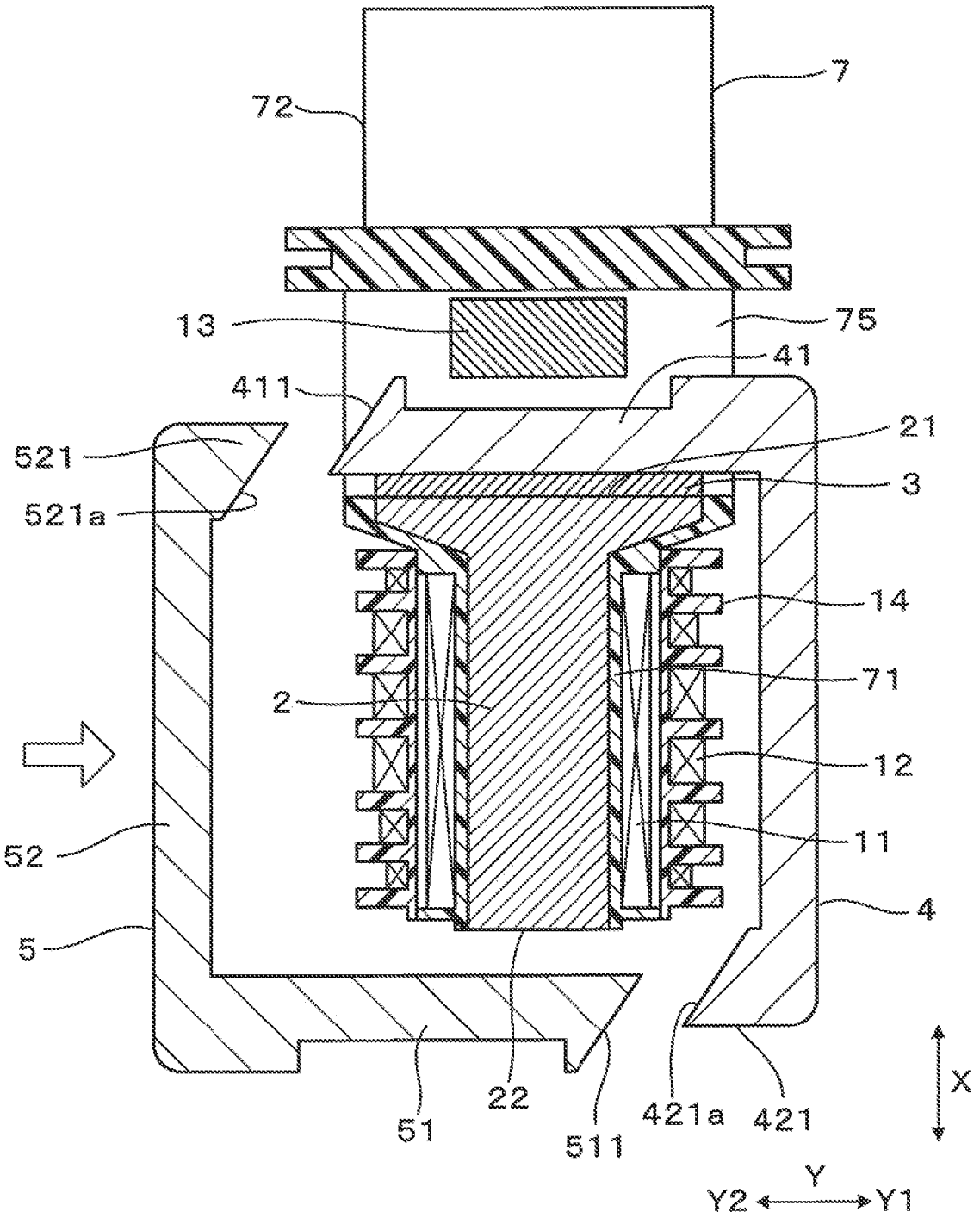
FIG. 5 is a sectional view which illustrates an ignition coil before a second core member is attached to a first core member of an ignition coil in the first embodiment.

First, the primary spool 71 around which the primary coil 11 is wound in the connector module 7 is, as demonstrated in FIG. 5, inserted into the secondary spool 14 around which the secondary coil 12 is wound. The igniter 13 is inserted into the installation chamber 75. The terminals of the igniter 13 (not shown) are joined or welded to the terminals of the connector 72.

Next, the magnet 3 is disposed on the front core surface 21 of the center core 2 which is exposed outside the connector module 7. The magnet 3 is then firmly jointed to the front core surface 21 of the center core 2 with aid of magnetic force produced by the magnet 3. Installation of the magnet 3 in the installation chamber 75 may be achieved by inserting the magnet 3 into the opening of the installation chamber 75 from the Z-direction.

Subsequently, the first core member 4 is inserted into the installation chamber 75 to have the first core-facing portion 41 face and contact the front surface of the magnet 3. The insertion of the first core member 4 into the installation chamber 75 may be achieved in the Y-direction or the Z-direction. The first core-facing portion 41 of the first core member 4 is, as described above, placed in contact with the front surface of the magnet 3 in the installation chamber 75, thereby achieving firm joint of the first core-facing portion 41 to the magnet 3 using the magnetic force produced by the magnet 3. This firmly secures the first core member 4 to the connector module 7 through the magnet 3.

Figure 6:
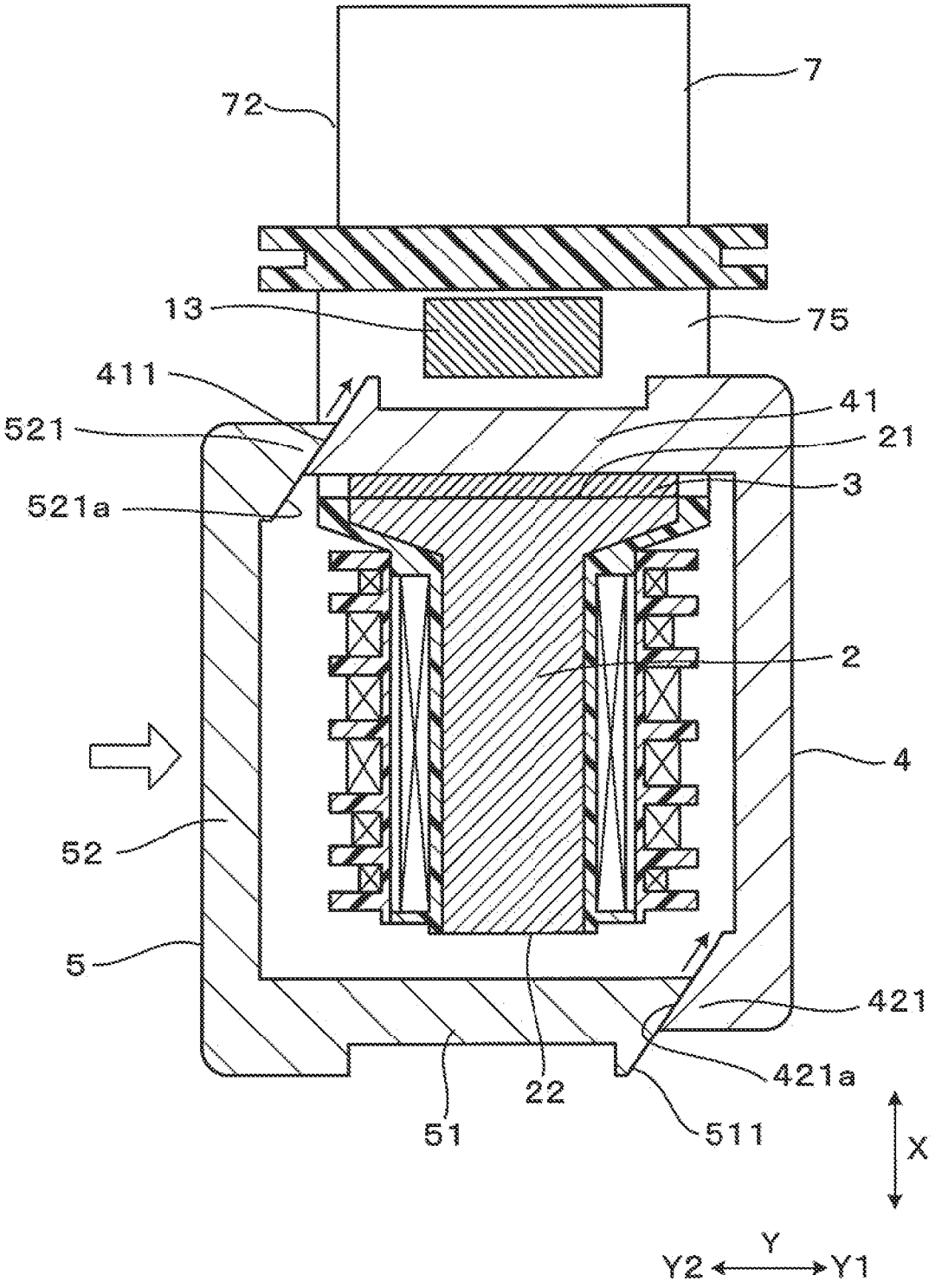
FIG. 6 is a sectional view which illustrates a first core member and a second core member which are placed in contact with each other in an assembly process of an ignition coil in the first embodiment.
Figure 7:
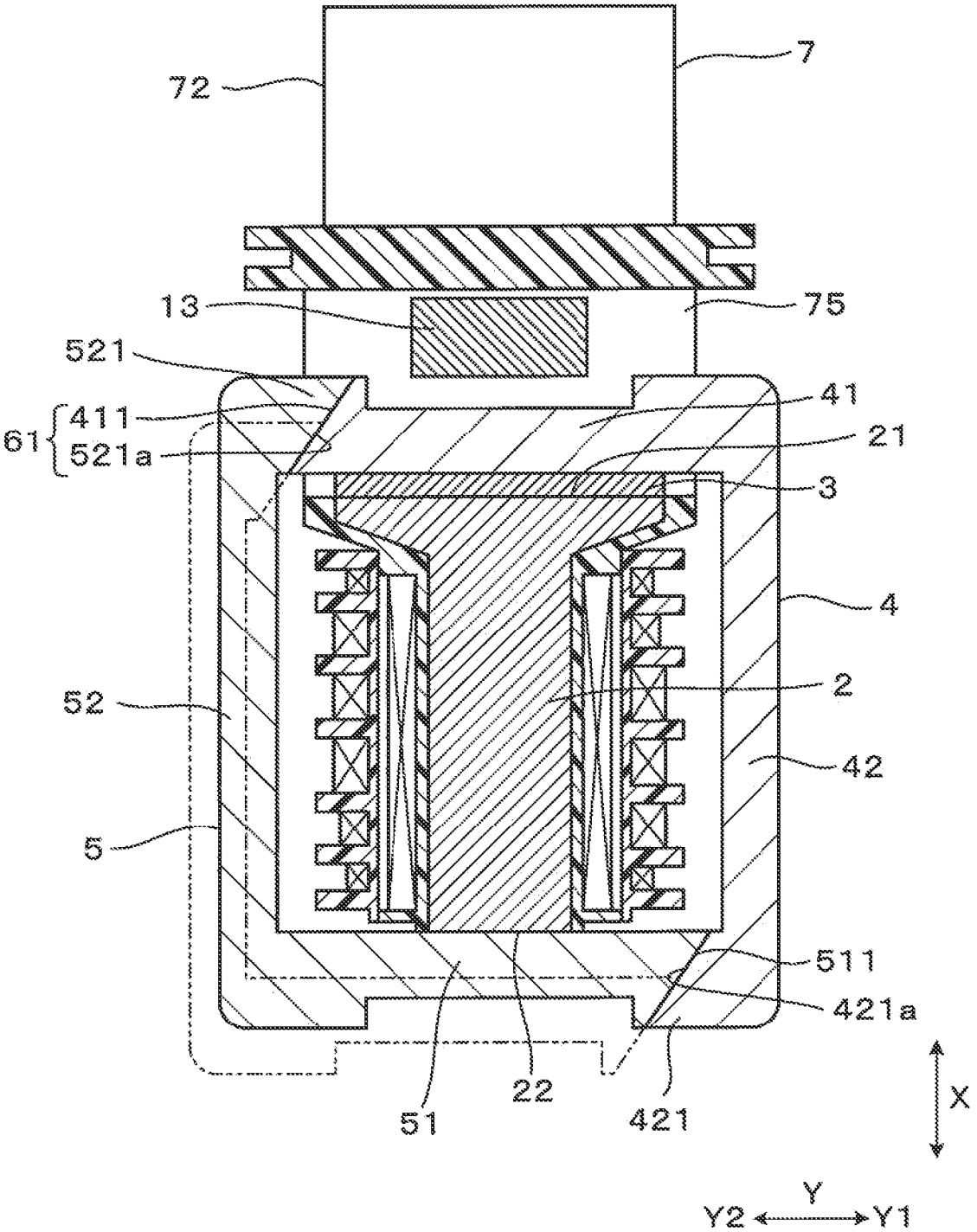
FIG. 7 is a sectional view which illustrates a first core member and a second core member which are positioned relative to each other in an ignition coil according to the first embodiment.

Next, the second core member 5 is, as illustrated in FIGS. 5 and 6, assembled with the first core member 4. Specifically, the second core member 5 is moved close to the first core member 4 in the Y-direction to bring the end surface 511 of the second core-facing portion 51 of the second core member 5 into contact with the first protrusion end surface 421*a* of the first protrusion 421 of the first core member 4 and also bring the second protrusion end surface 521*a* of the second protrusion 521 of the second core member 5 into contact with the end surface 411 of the first core-facing portion 41 of the first core member 4. This arrangement is illustrated in FIG. 6. The second core-facing portion 51 of the second core member 5 is separate from the rear core surface 22 of the center core 2 through an air gap.

Subsequently, the second core member 5 is, as demonstrated in FIGS. 6 and 7, further pressed toward the first core member 4 in the Y1-direction, thereby causing the end surface 511 of the second core-facing portion 51 of the second core member 5 to slide on the first protrusion end surface 421*a* of the first protrusion 421 of the first core member 4 and also causing the second protrusion end surface 521*a* of the second protrusion 521 to slide on the end surface 411 of the first core-facing portion 41. This causes the second core member 5 to be moved in the Y1-direction relative to the first core member 4 and simultaneously moved frontward (i.e., in a diagonal direction indicated by arrows in FIG. 6). This movement, as demonstrated in FIG. 7, results in a decreased gap between the first core-facing portion 41 and the second core-facing portion 51. Finally, the second core-facing portion 51 of the second core member 5 contacts the rear core surface 22 of the center core 2, so that the first core-facing portion 41 of the first core member 4 is magnetically attracted by the magnet 3 to make a firm joint therebetween, and the second core-facing portion 51 of the second core member 5 is firmly attached to the rear core surface 22 of the center core 2, thereby positioning the second core member 5 relative to the first core member 4 both in the X-direction and in the Y-direction.

Immediately before the first core member 4 and the second core member 5 are attached to each other, as illustrated in FIG. 5, the igniter 13 and the connector 72 exist in front of the outer core 6. It is, therefore, impossible to press the first core member 4 and the second core member 5 in the X-direction in order to position the first core member 4 and the second core member 5 relative to each other. In order to eliminate such a drawback, the ignition coil 1 is designed to achieve positioning of the first core member 4 and the second core member 5 in the X-direction and the Y-direction only by pressing the second core member 5 in the Y-direction to bring the first core-facing portion 41 into contact with the front surface of the magnet 3 and also bring the second core-facing portion 51 into contact with the rear core surface 22 of the center core 2. This enhances the productivity of the ignition coil 1.

The ignition coil 1 in this embodiment offers the following beneficial advantages.

The first contact region 61 and the second contact region 62 of the ignition coil 1 are shaped to be moved frontward resulting from being pressed in the Y1-direction. This enables assembly of the first core member 4 and the second core member 5 with the center core 2 and the magnet 3 to be achieved in the above way, that is, by moving the first core member 4 and the second core member 5 close to each other in the Y-direction to create the first contact region 61 and the second contact region 62, and then pressing the second core member 5 against the first core member in the Y1-direction, thereby causing the first core member 4 and the second core member 5 to slide at the first contact region 61 and the second contact region 62, so that the second core member 5 is shifted frontward and in the Y1-direction. This decreases an interval between the second core-facing portion 51 and the first core-facing portion 41, so that the first core-facing portion 41 then contacts the front surface of the magnet 3, and the second core-facing portion 5 also contacts the rear core surface 22 of the center core 2. The positioning of the first core member 4 and the second core member 5 relative to each other in the X-direction and in the Y-direction is achieved in the above way, that is, only by pressing the first core member 4 and the second core member 5 against each other in the Y-direction to bring the first core-facing portion 41 into contact with the front surface of the magnet 3 and also bring the second core-facing portion 51 into contact with the rear core surface 22 of the center core 2. This improves the productivity of the ignition coil 1.

The magnet 3 is disposed between the front core surface 21 of the center core 2 and the first core-facing portion 41 of the first core member 4, thereby facilitating the enhancement of productivity of the ignition coil 1. For instance, assembly of the center core 2, the magnet 3, the first core member 4, and the second core member 5 may be accomplished by placing the magnet 3 on the front core surface 21 of the center core 2, arranging the first core member 4 in front of the magnet 3 to cause magnetic attraction, as produced by the magnet 3, to join the center core 2, the magnet 3, and the first core member 4 together, and then attaching the second core member 5 to the first core member 4 which has already joined to the center core 2 and the magnet 3 together.

A dimensional variability of the first core member 4 or the second core member 5 may result in misalignment between the end surface 411 of the first core-facing portion 41 and the second protrusion end surface 521*a* of the second protrusion 521 or between the first protrusion end surface 421*a* of the first protrusion 421 and the end surface 511 of the second core-facing portion 51 when the first core member 4 and the second core member 5 are attached to each other, which leads to a decreased area where the first core member 4 and the second core member 5 face each other, thereby causing a risk that magnetic flux may leak from the outer core 6.

In order to avoid the above problem, at least one of the end surface 411 of the first core-facing portion 41 and the second protrusion end surface 521*a* of the second protrusion 521 which create the first contact region 61 is, as described above, shaped to have a dimension which is larger in the X-direction than that of a given portion of the first core-facing portion 41 which is located away from the first contact region 61 in the Y1-direction (i.e., toward the first core side portion 42). Additionally, at least one of the end surface 511 of the second core-facing portion 51 and the first protrusion end surface 421*a* of the first protrusion 421 which create the second contact region 62 is shaped to have a dimension which is larger in X-direction than that of a given portion of the second core-facing portion 51 which is located away from the second contact region 62 in the Y2-direction (i.e., toward the second core side portion 52). This ensures required areas where the end surface 411 of the first core-facing portion 41 and the second core member 5 face each other, in other words, are aligned with each other in the Y-direction and where the end surface 511 of the second core-facing portion 51 and the first core member 4 face each other, in other words, are aligned with each other in the Y-direction, thereby minimizing a leakage of magnetic flux from the outer core 6 to ensure the desired ability of the ignition coil 1.

The front lateral side 63 of the outer core 6 is equipped with the core protrusions 65 which are opposed to each other across the igniter 13 in the Y-direction and project frontward, that is, toward the igniter 13 in the X-direction. This facilitates release of heat, as generated by the igniter 13, from the core protrusions 65 to the outer core 6. The core protrusions 65 do not occupy a region (i.e., the core recess 66) where a portion of the front lateral side 63 faces the igniter 13 in the X-direction, thereby enabling the size of the ignition coil 1 to be reduced in the X-direction. The rear lateral side 63, like the front lateral side 63, has the core protrusions 65 which are formed on ends thereof and project rearward. This enables the first core member 4 and the second core member 5 to be formed into the same shape, thereby enhancing the productivity of the outer core 6.

The first contact region 61 and the second contact region 62 are each shaped to have a flat or even surface and extend parallel to each other. This ensures a desired area of each of the first contact region 61 and the second contact region 62, that is, areas of contact between the end surface 411 of the first core-facing portion 41 and the second protrusion end surface 521*a* of the second protrusion 521 and between the end surface 511 of the second core-facing portion 51 and the first protrusion end surface 421*a* of the first protrusion 421. This minimizes a risk of occurrence of air gaps on the first and second contact regions 62, thus ensuring the required ability of the ignition coil 1.

The first core side portion 42 includes the first straight portion 420 and the first protrusion 421. Similarly, the second core side portion 52 includes the second straight portion 520 and the second protrusion 521. The first protrusion end surface 421*a* of the first protrusion 421 forms the second contact region 62. The second protrusion end surface 521*a* of the second protrusion 521 forms the first contact region 61. In other words, the first contact region 61 is created by an end surface (i.e., the second protrusion end surface 521*a*) of the second protrusion 521 projecting from the second straight portion 520. Similarly, the second contact region 62 is created by an end surface (i.e., the first protrusion end surface 421*a*) of the first protrusion 421 projecting from the first straight portion 420. It is, thus, possible for the ignition coil 1 in this embodiment to create the first contact region 61 and the second contact region 62 using simple configurations.

The whole of the first protrusion end surface 421*a* of the first protrusion 421 is located away from the first straight portion 420 in the Y-direction. Similarly, the whole of the second protrusion end surface 521*a* of the second protrusion 521 is located away from the second straight portion 520 in the perpendicular direction (i.e., the Y-direction). This minimizes a risk that in assembly of the first core member 4 and the second core member 5, sliding motion of the first core member 4 and the second core member 5 relative to each other may be obstructed by undesirable contact of the first core member 4 with the second straight portion 520 or the second core member 5 with the first straight portion 420.

As apparent from the above discussion, the structure of the ignition coil 1 in this embodiment improves the productivity thereof.

Second Embodiment

Figure 8:
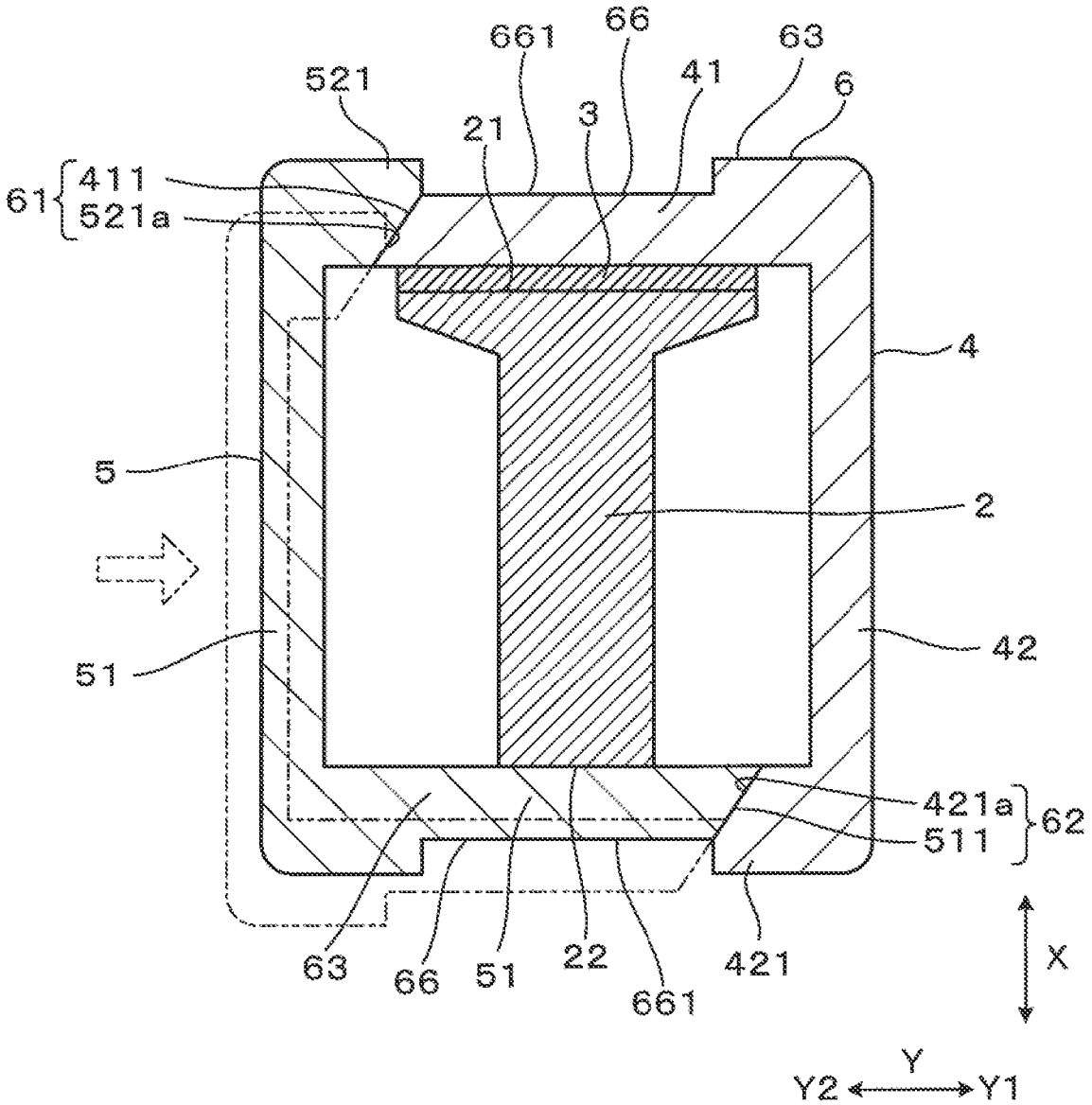
FIG. 8 is a sectional view which illustrates a center core, a magnet, and an outer core of an ignition coil according to the second embodiment.

The second embodiment is, as illustrated in FIG. 8, different in locations of contacts or joints between the first core member 4 and the second core member 5 of the outer core 6 from the first embodiment.

Specifically, the end surface 411 of the first core-facing portion 41 of the first core member 4 is shaped to have a front edge continuing to a first end of the bottom surface 661 of the recess 66 of the front lateral side 63 of the outer core 6. The bottom surface 661 has the first end and a second aligned with the first end in the Y-direction. The first end is located closer to the second core side portion 51 than the second end thereof is. The end surface 411 of the first core-facing portion 41 has a dimension in the X-direction which is identical with that of a portion of the first core-facing portion 41 in which the core recess 66 is formed in the X-direction. The bottom surface 661 of the core recess 66 of the rear lateral side 63 has a first end and a second end aligned with the first end in the Y-direction. The first end of the bottom surface 661 is located closer to the second core side portion 52 than the second end is. The second core-facing portion 51 of the second core member 5 is shaped to have a rear end continuing to the second end of the bottom surface 661 of the core recess 66 of the rear lateral side 63. The end surface 511 of the second core-facing portion 51 is shaped to have a dimension in the X-direction which is identical with that of a portion of the second core-facing portion 51 in which the core recess 66 is formed in the X-direction. The first core member 4 and the second core member 5 are identical in configuration or shape with each other.

Other arrangements of the ignition coil 1 in the second embodiment are identical with those in the first embodiment.

Reference numbers employed in the second embodiment and the following embodiment refer to the same parts as those in the first embodiment unless otherwise specified.

The structure of the ignition coil 1 in the second embodiment offers substantially the same beneficial advantages as those in the first embodiment.

Third Embodiment

Figure 9:
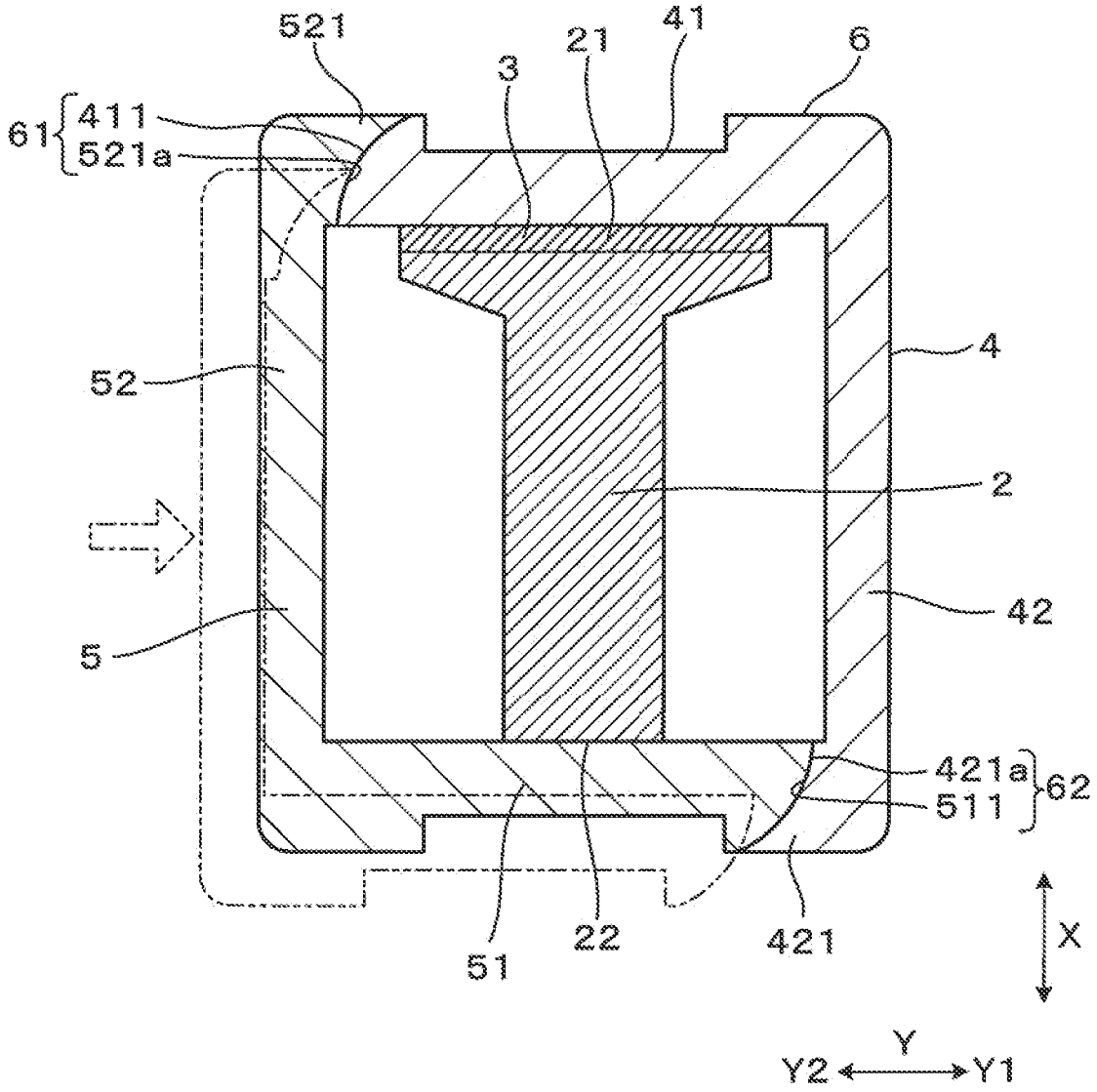
FIG. 9 is a sectional view which illustrates a center core, a magnet, and an outer core of an ignition coil according to the third embodiment.

FIG. 9 illustrates an assembly of the center core 2 and the outer core 6 of the ignition coil 1 according to the third embodiment. The third embodiment is different in configuration of the first contact region 61 and the second contact region 62 from the first embodiment.

Specifically, the end surface 411 of the first core-facing portion 41 which forms the first contact region 61 and the end surface 511 of the second core-facing portion 51 which forms the second contact region 62 are each shaped to be curved in the form of a convex surface bulging diagonally frontward. The first protrusion end surface 421*a* of the first protrusion 421 is shaped to be curved in the form of a concave surface contoured to conform with the end surface 511 of the second core-facing portion 51. Similarly, the second protrusion end surface 521*a* of the second protrusion 521 is shaped to be curved in the form of a concave surface contoured to conform with the end surface 411 of the first core-facing portion 41. The first core member 4 and the second core member 5 are identical in configuration or shape with each other. The end surface 411 of the first core-facing portion 41 and the end surface 511 of the second core-facing portion 51 may alternatively be formed in a concave shape, while the first protrusion end surface 421*a* of the first protrusion 421 and the second protrusion end surface 521*a* of the second protrusion 521 may be formed in a convex shape.

Other arrangements of the ignition coil 1 in the third embodiment are identical with those in the first embodiment.

The structure of the ignition coil 1 in the third embodiment offers substantially the same beneficial advantages as those in the first embodiment.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. An ignition coil comprising:

a primary coil and a secondary coil which are magnetically coupled with each other;

a center core which is disposed inside inner peripheries of the primary coil and the secondary coil, the center core having a first surface and a second surface aligned with the first surface in an axial direction of the primary and the secondary coils;

a first core member which includes a first core-facing portion and a first core side portion, the first core-facing portion faces the first surface of the center core, the first core side portion extending from the first core-facing portion in a first axial direction defined to be opposite a second axial direction along the axial direction of the primary and secondary coils, the first core member being arranged outside outer peripheries of the primary coil and the secondary coil; and a second core member which includes a second core-facing portion and a second core side portion, the second core-facing portion facing the second surface of the center core, the second core side portion extending from the second core-facing portion in the second axial direction and being located on an opposite side of the center core to the first core side portion in an orthogonal direction perpendicular to the axial direction of the primary and secondary coils, the second core member being arranged outside the outer peripheries of the primary coil and the secondary coil, wherein the first core-facing portion has an end surface which faces away from the first core side portion in the orthogonal direction, the end surface of the first core-facing portion facing in contact with a portion of the second core side portion to create a first contact region, the second core-facing portion has an end surface which faces away from the second core side portion in the orthogonal direction, the end surface of the second core-facing portion facing in contact with a portion of the first core side portion to create a second contact region, and each of the first contact region and the second contact region is shaped to approach in the second axial direction close to the first core side portion facing the second core side portion in the orthogonal direction.

2. The ignition coil as set forth in claim 1, wherein a magnet is disposed between the first surface of the center core and the first core-facing portion of the first core member.

3. The ignition coil as set forth in claim 1, wherein at least one of the end surface of the first core-facing portion and a surface of the portion of the second core side portion which creates the first contact region has a dimension which is larger in the axial direction of the primary and secondary coils than that of a given portion of the first core-facing portion which is located closer to the first core side portion than the first contact region is in the orthogonal direction, at least one of the end surface of the second core-facing portion and a surface of the portion of the first core side portion which creates the second contact region has a dimension which is larger in the axial direction of the primary and secondary coils than that of a given portion of the second core-facing portion which is located closer to the second core side portion than the second contact region is in the orthogonal direction.

4. The ignition coil as set forth in claim 1, wherein the first contact region and the second contact region are each shaped to have an even surface and extend parallel to each other.

5. The ignition coil as set forth in claim 1, wherein the first core side portion includes a first straight portion and a first protrusion, the first straight portion extending straight from the first core-facing portion in the first axial direction and having an end facing in the first axial direction, the first protrusion projecting from the end of the first straight portion toward the second core side portion in the orthogonal direction, the second core side portion includes a second straight portion and a second protrusion, the second straight portion extending straight from the second core-facing portion in the second axial direction and having an end facing in the second axial direction, the second protrusion projecting from the end of the second straight portion toward the first core side portion in the orthogonal direction, the first protrusion has a first protrusion end surface which faces the second core side portion in the orthogonal direction and defines the second contact region, the second protrusion has a second protrusion end surface which faces the first core side portion in the orthogonal direction and defines the first contact region.

6. The ignition coil as set forth in claim 5, wherein a whole of the first protrusion end surface of the first protrusion is located away from the first straight portion in the orthogonal direction, and wherein a whole of the second protrusion end surface of the second protrusion is located away from the second straight portion in the orthogonal direction.

* * * * *